US006068536A

United States Patent [19]

Madland et al.

[11] Patent Number: 6,068,536

[45] Date of Patent: May 30, 2000

[54] MECHANISM FOR ANIMATED CHARACTER

[75] Inventors: Douglas J. Madland; Nathan Wayne Foster, both of East Wenatchee, Wash.

[73] Assignee: Merriment Inc., East Wenatchee, Wash.

[21] Appl. No.: 09/301,779

[22] Filed: Apr. 29, 1999

[51] Int. Cl.[7] ..... A63H 3/36

[52] U.S. Cl. ..... 446/337; 446/366

[58] Field of Search ..... 446/329, 330, 446/337, 366, 371, 373, 375, 391, 395, 298

[56] References Cited

U.S. PATENT DOCUMENTS

| | | | |
|---|---|---|---|
| 440,706 | 11/1890 | Graeser | 446/345 |
| 961,262 | 6/1910 | Slough | 446/395 X |
| 1,974,366 | 9/1934 | Pollock | 446/339 |
| 2,101,102 | 12/1937 | Schaeffer | 446/337 |
| 2,184,639 | 12/1939 | Weline | 446/339 |
| 2,324,774 | 7/1943 | Henry | 446/342 |
| 2,507,394 | 5/1950 | Aube | 446/339 |
| 2,686,388 | 8/1954 | Seidl | 446/340 |
| 3,021,641 | 2/1962 | Banks | 446/340 |
| 3,195,268 | 7/1965 | Neumann et al. | 446/337 |
| 3,494,068 | 2/1970 | Crosman | 446/333 |
| 3,745,696 | 7/1973 | Sapkus et al. | 446/333 |
| 3,828,469 | 8/1974 | Giroud | 446/337 |
| 3,841,020 | 10/1974 | Ryan et al. | 446/190 |
| 3,881,275 | 5/1975 | Baulard-Cogan | 446/351 |
| 4,139,968 | 2/1979 | Milner | 446/301 |
| 4,177,589 | 12/1979 | Villa | 40/457 |
| 4,805,328 | 2/1989 | Mirahem | 40/480 |
| 4,808,142 | 2/1989 | Berliner | 446/175 |
| 4,850,930 | 7/1989 | Sato et al. | 446/175 |
| 4,869,703 | 9/1989 | Ong S.T. | 446/353 |
| 4,900,289 | 2/1990 | May et al. | 446/342 |
| 4,923,428 | 5/1990 | Curran | 446/175 |
| 5,074,821 | 12/1991 | McKeefery et al. | 446/299 |
| 5,407,376 | 4/1995 | Avital et al. | 446/175 |
| 5,413,516 | 5/1995 | Lam | 446/301 |

*Primary Examiner*—Sam Rimell

*Attorney, Agent, or Firm*—Christensen O'Connor Johnson & Kindness pllc

[57] ABSTRACT

A character (2) capable of forming facial expressions is provided. The character includes a hollow head (4) with a face defining a mouth (6) thereon. The mouth has a length and includes a first end portion (6A) and a second end portion (6B). The character further includes, externally or within the hollow head, a mechanism (7) for causing various facial expressions. The mechanism includes a main frame plate (8), a mouth assembly (10) fixedly mounted on the main frame plate, and a drive assembly (12) also mounted on the main frame plate. The mouth assembly includes an upper lip chain (14) which is formed from a plurality of links (16) and has a first end (14*a*) and a second end (14*b*). The drive assembly is adapted to move at least one of the first and second ends of the upper lip chain and, hence, at least one of the corresponding end portions of the mouth, to cause various facial expressions, such as a smile, frown, or mumbling mouth.

20 Claims, 12 Drawing Sheets

MECHANISM FOR ANIMATED CHARACTER

FIELD OF THE INVENTION

The present invention relates to a mechanized animated character including a face and, more specifically, to a mechanism used to cause various expressions on the face of an animated character.

BACKGROUND OF THE INVENTION

The human penchant for viewing human-like facial expressions that smile or talk has often led to the development of animated characters that have mouths which open and close. Various mechanisms have been proposed in the past to be included within the head of a doll to cause the mouth of the doll to mimic speaking. For example, U.S. Pat. No. 4,177,489 to Villa describes an animated face with three-dimensional facial features. Villa includes a facial control system comprising two springs embedded within two lips, respectively, that are controlled at their terminal ends by pneumatic valves to open or close the mouth. While the mouth rounds when opened, it does not curve into a true smile. U.S. Pat. No. 3,828,469 to Giroud describes a mechanism having two operating rods for moving upper and lower lips, respectively. U.S. Pat. No. 4,900,289 to May et al. describes a mechanism for animating a doll's facial features, wherein a motor actuates various gears to reciprocate a rod, which moves a mouth or jaw of the doll. In general, such devices merely mimic opening and closing of the mouth. However, such devices do not accurately portray an arcuate smile or frown, or other such complex facial movements.

As apparent from a review of prior art, the art of providing a doll having an internal mechanism to cause the doll to open and close its mouth is known, but is limited in the ability to portray more complex facial features. In particular, conventional mechanisms do not enable the realistic portrayal of smiles, frowns, complex speech, mumbling, and the like. The present invention is directed in part to accomplishing this. Further, the present invention is directed in part to providing a mechanism with versatility in that a single mechanism may be used to create various facial expressions with simple adjustments of components. The present invention has utility for use in animated characters, such as human or animal characters, and other animated devices designed to include a face, e.g., apples, waste cans, car grilles, sporting goods, holiday-related ornaments, and decorations, etc. Such devices have utility in the entertainment, educational, advertising, therapeutic, and toy fields.

SUMMARY OF THE INVENTION

An animated character capable of forming facial expressions is provided. The character includes a hollow head or other facial structure to be animated, including a face defining a mouth therein. The mouth has a length and includes a first end portion and a second end portion. The character further includes, externally or within the hollow head, a mechanism for causing various facial expressions. The mechanism includes a main frame, a mouth assembly mounted on the main frame, and a drive assembly that is also mounted on the main frame. The mouth assembly includes a first mouth chain having a first end and a second end, which chain is formed from a plurality of links. The first mouth chain is disposed to underlie the mouth, with the first and second ends of the first mouth chain generally coinciding with the first and second end portions of the mouth. The drive assembly is adapted to move at least one of the first and second ends of the first mouth chain or an intermediate portion thereof and, hence, the corresponding portion of the mouth, to cause various facial expressions, such as a smile or frown or those movements entailed in speaking or mumbling. While the present specification makes reference to a "head", this term is to be understood to encompass other three-dimensional structures to be animated, such as by way of nonlimiting examples, human-like heads, animal-like heads, fruits and vegetables (apples, pumpkins, etc.), or mechanical devices (auto grilles, computer monitors, waste cans, etc.).

In one aspect of the present invention, the drive mechanism includes at least one cam and a rotational drive for rotating the cam. The cam is coupled to at least one end of the first mouth chain.

In another aspect of the present invention, the mouth assembly may further include a second mouth backing member that moves in conjunction with the first mouth chain. In a preferred embodiment, the first mouth chain supports the upper lip, and the second mouth backing member supports the lower lip or jaw.

In a further aspect of the present invention, the invention includes various adjustments to change the initial and final angular displacement of the first mouth chain, and the second mouth backing member, if one is provided, so as to achieve various facial expressions with differing nuances around the mouth.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
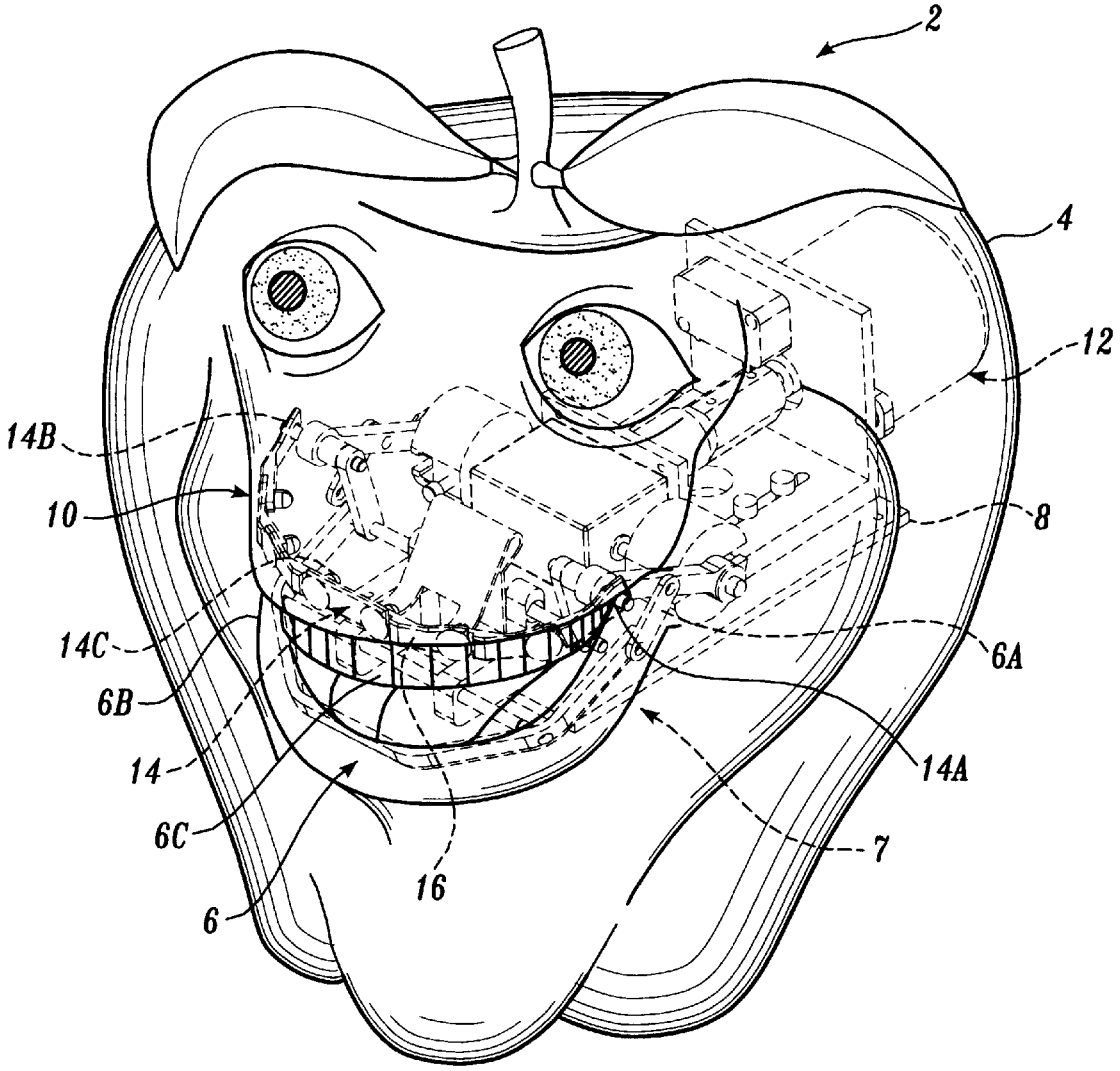
FIG. 1 is a perspective view of a character including a hollow head in the form of an apple, which is capable of forming facial expressions in accordance with the present invention.

FIG. 1 is a perspective view of a character 2 formed in accordance with a first embodiment of the present invention. The character 2 includes a hollow head 4 having a face that defines a mouth 6 therein, which is in the form of an apple in the illustrated embodiment. The formation of the character as an apple is only one possible configuration of a wide variety of possible configurations, including human, animal, plant, machine, and other realistic or fanciful configurations. The mouth 6 includes a first end portion 6A, a second end portion 6B, and a central portion 6C. The face of the hollow head 4 is formed of an elastically deformable material, such as a silicone or polyurethane elastomer, so as to be able to express various facial expressions when the mouth 6 is moved, as more fully described below. The character 2 further includes, externally or within the hollow head 4, a mechanism 7 for causing various facial expressions, such as a smile, frown, guffaw, speech, or mumbling.

The mechanism 7 includes a main frame plate 8, a mouth assembly 10 fixedly mounted on the main frame plate 8, and a drive assembly 12 also mounted on the main frame plate 8. The mouth assembly 10 includes an upper lip chain 14 having a first end 14A, a second end 14B, and a center portion 14C. The upper lip chain 14 comprises a plurality of links 16. The upper lip chain 14 is disposed to underlie the mouth 6, with the first and second ends 14A, 14B of the upper lip chain 14 generally coinciding with the first and second end portions 6A, 6B of the mouth 6. The drive assembly 12 is adapted to move at least one of the first and second ends 14A, 14B of the upper lip chain 14 or an intermediate portion thereof and, hence, the corresponding end portion 6A or 6B of the mouth 6 or an intermediate portion thereof, to cause various facial expressions, such as a smile, as illustrated in FIG. 1.

Figure 2A:
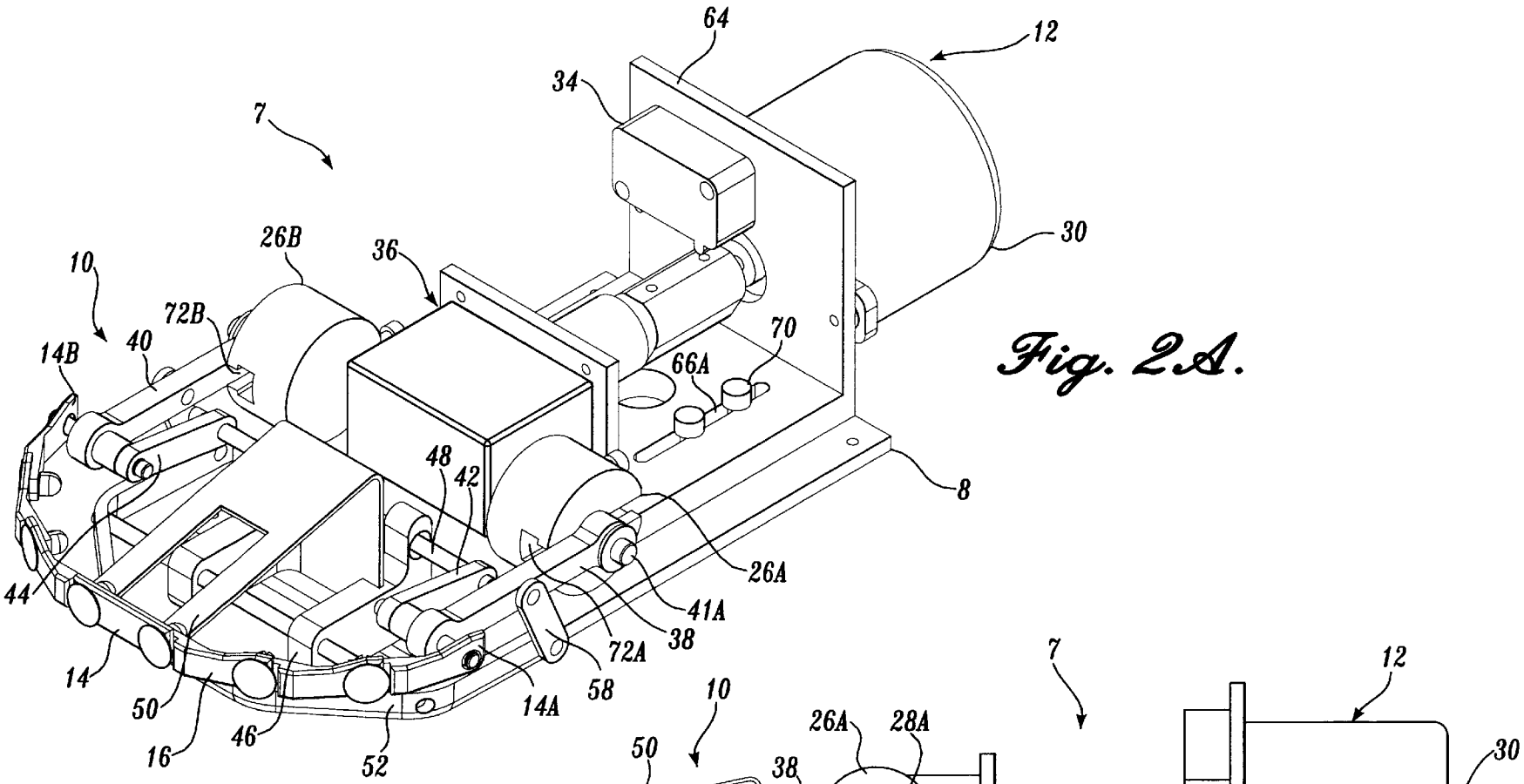
FIG. 2A is a perspective view of a mechanism including a mouth assembly and a drive assembly, which are suitably housed within the apple head of FIG. 1.
Figure 2B:
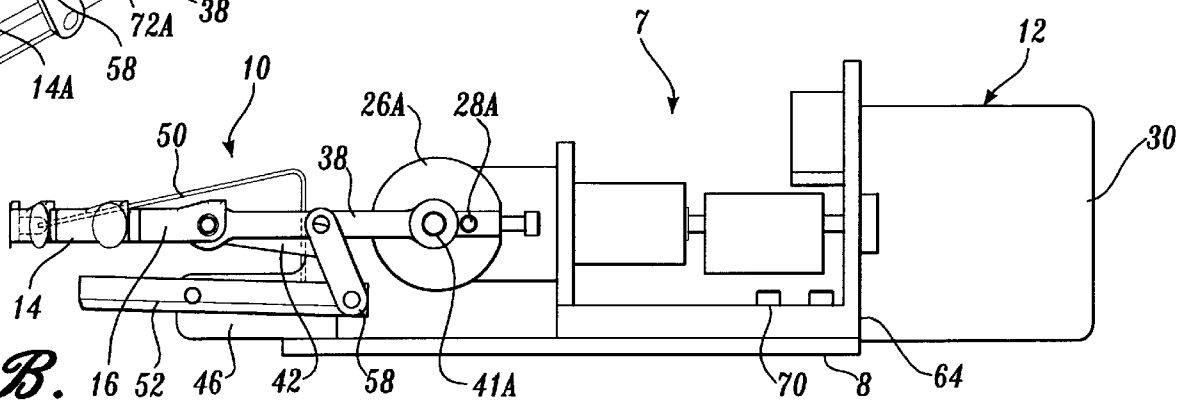
FIG. 2B is a side view of the mechanism of FIG. 2A.
Figure 3:
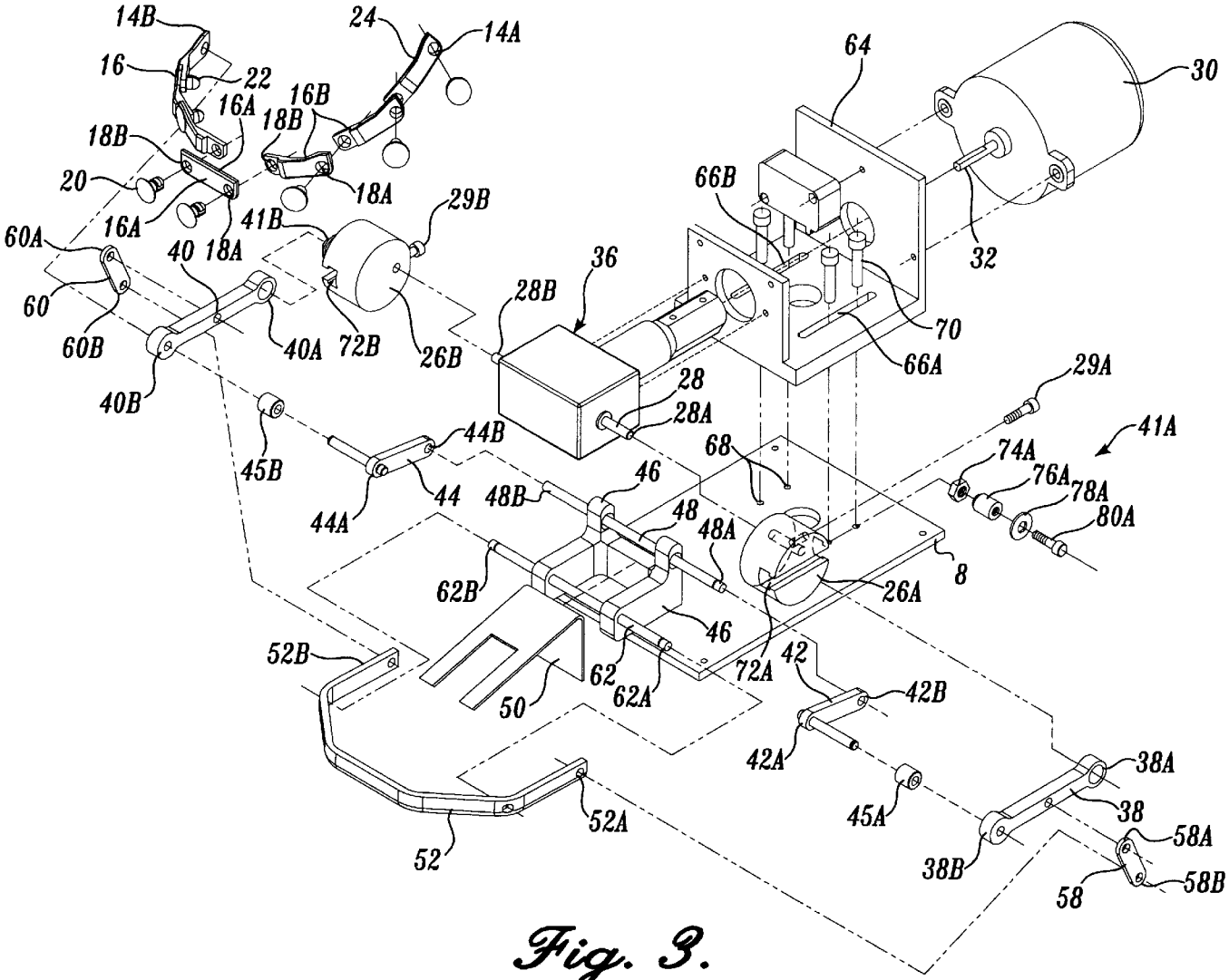
FIG. 3 is an exploded view of the mechanism of FIG. 2A.

FIGS. 2A and 2B illustrate the mechanism 7 for causing facial expressions as shown in FIG. 1. Referring additionally to FIG. 3, which is an exploded view of the mechanism 7, the mouth assembly 10 includes the upper lip chain 14 formed of a plurality of links 16. Each link 16 includes a pair of holes 18A, 18B. A rivet 20, for example, a nylon rivet having split distal ends 22, is inserted through the hole 18A of one link 16 and the hole 18B of an adjacent link 16 to couple the links 16 together. As best illustrated in FIG. 3, while a central link 16A is a generally flat plate, links 16B on both sides of the central link 16A include a bent portion 24 so as to cooperatively form the upper lip chain 14 having a smooth curvature. The upper lip chain 14 thus constructed is advantageous in that it can move three-dimensionally. Specifically, with the central link 16A being held as a fixed point, the first and second ends 14A, 14B of the upper lip chain 14 may move not only vertically (up and down), but also move horizontally (backward and forward). In the present application, the term "backward" is used to indicate the direction generally toward the drive assembly 12 from the mouth assembly 10, and the term "forward" is used to indicate the opposite direction. Other mouth backing structure in place of a chain, such as a one-piece or composite plastic molding with flexible joints, a spring element, or independently movable connection points are also possible within the scope of the present invention.

Still referring to FIGS. 2A, 2B, and 3, the drive assembly 12 for moving the first and second ends 14A, 14B of the upper lip chain 14 includes an eccentric first cam 26A that rotates on a first end 28A of an axle 28 and an eccentric second cam 26B that rotates on a second end 28B of the axle 28. A first set screw 29A and a second set screw 29B are suitably used to secure the first and second cams 26A, 26B to the first and second axle ends 28A, 28B, respectively.

The drive assembly 12 further includes a rotational drive for rotating the first and second cams 26A, 26B. In the illustrated embodiment, the rotational drive includes an electric motor 30 having a rotating power shaft 32, which rotates on an axis disposed perpendicularly to the axis of rotation of axle 28. The motor 30 may further include a controller 34 to actuate operation of the motor 30. The rotational drive further includes a transmission such as a miter gear assembly 36 coupled to the motor 30, which is adapted to transmit the rotation of the power shaft 32 to the axle 28 and eccentric first and second cams 26A, 26B. The miter gear assembly 36 may comprise, for example, a conventional worm gear and a toothed wheel, as apparent to those skilled in the art.

The controller 34 may suitably comprise a manual or remotely activated (e.g., by radiofrequency, infrared, or ultrasound) switch, or may suitably contain circuitry to activate the motor 30 randonily, periodically, in a complex pattern, or in response to a sensed signal such as sound, for example. Thus, the controller 34 can be designed in accordance with the present invention for smiling, speech, etc., in a random or responsive fashion.

Other drive arrangements may be utilized for the cams 26A, 26B. For example, the rotational drive may include an electric motor having two power shafts extending from opposite sides of the motor on which the first and second cams 26A, 26B, respectively, are mounted.

The first and second ends 14A, 14B of the upper lip chain 14 are coupled to the first and second cams 26A, 26B, respectively. When the motor 30 is turned on, rotational energy of the power shaft 32 is transmitted via the miter gear assembly 36 to rotate the first and second cams 26A and 26B, so as to move the first and second ends 14A, 14B of the upper lip chain 14, respectively, as more fully described below.

Still referring to FIGS. 2A, 2B, and 3, coupling of the upper lip chain 14 to the first and second cams 26A, 26B is described. In the illustrated embodiment, the mouth assembly 10, including the upper lip chain 14, further includes a first linkage 38 having a first end 38A and a second end 38B and a second linkage 40 having a first end 40A and a second end 40B. The first end 38A of the first linkage 38 is pivotally coupled to a first coupler 41A of the first cam 26A, and the first end 40A of the second linkage 40 is pivotally coupled to a second coupler 41B of the second cam 26B. The second end 38B of the first linkage 38 is pivotally coupled to the first end 14A of the upper lip chain 14, and the second end 40B of the second linkage 40 is pivotally coupled to the second end 14B of the upper lip chain 14.

The mouth assembly 10 further includes a first pivot arm 42 having a first end 42A and a second end 42B and a second pivot arm 44 having a first end 44A and a second end 44B.

The first end 42A of the first pivot arm 42 is pivotally coupled to the second end 38B of the first linkage 38, and the first end 44A of the second pivot arm 44 is pivotally coupled to the second end 40B of the second linkage 40. Spacers 45A, 45B are provided between the first ends 42A, 44A of the first and second pivot arms 42, 44 and the second ends 388B, 40B of the first and second linkages 38, 40, respectively. The mouth assembly 10 further includes a bracket 46 securely fixed to the main frame plate 8. The bracket 46 supports a first jaw axle 48 having a first end 48A and a second end 48B. The first jaw axle 48 extends in parallel with the axle 28, and is supported at an elevation above the main frame plate 8. The second end 42B of the first pivot arm 42 is pivotally coupled to the first end 48A of the first jaw axle 48, and the second end 44B of the second pivot arm 44 is pivotally coupled to the second end 48B of the first jaw axle 48.

The mouth assembly 10 preferably further includes a spring 50 attached to the bracket 46 and the upper lip chain 14. The spring 50 is provided to support and bias the center portion 14C of the upper lip chain 14 downwardly upon elevation of the ends 14A, 14B of the upper lip chain 14. Any other suitable linkage to bias the chain may be utilized in place of the spring 50.

Figure 4:
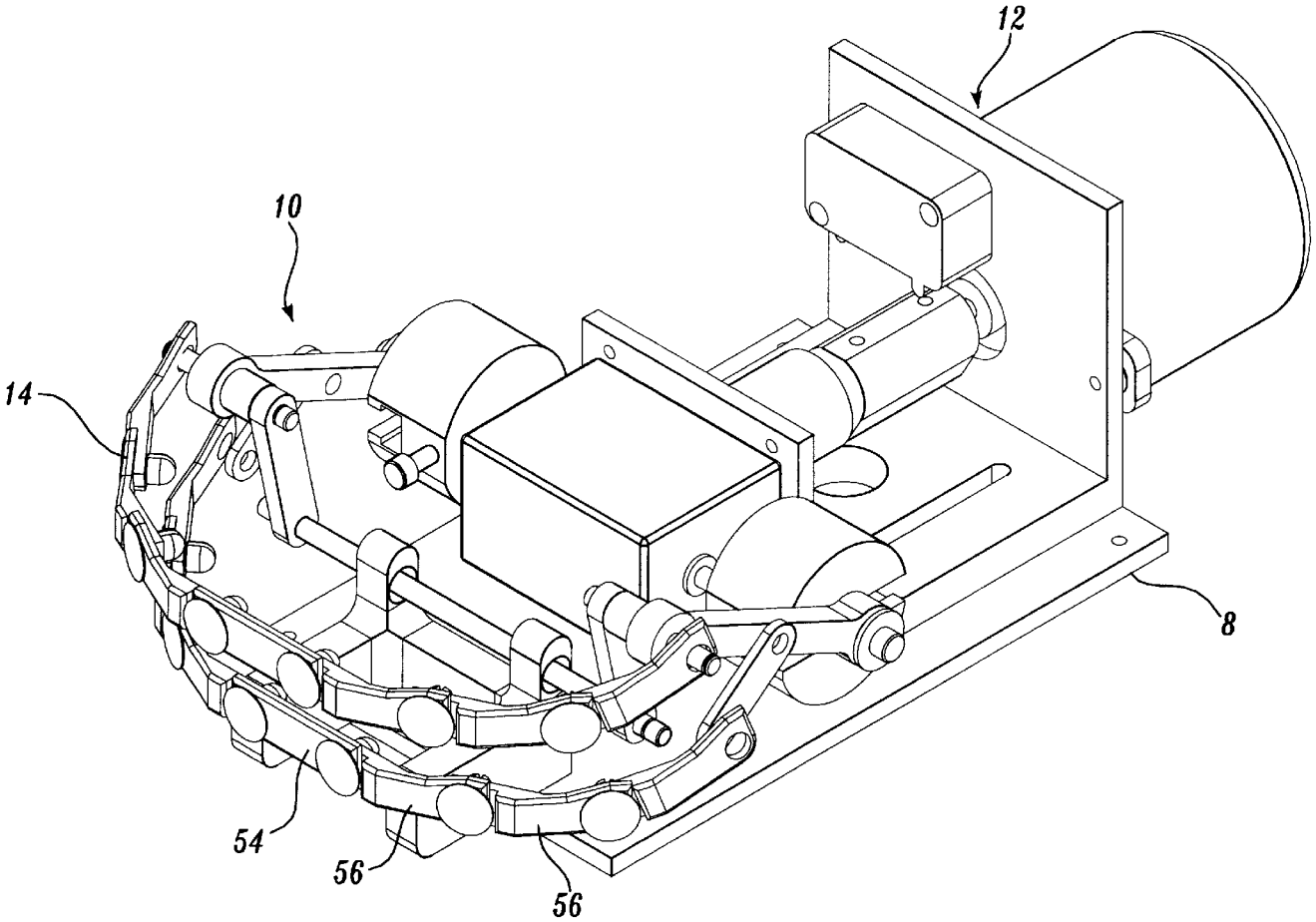
FIG. 4 is a perspective view of the mechanism of FIG. 2A, with a rigid lower jaw being replaced with a lower mouth chain.

Optionally, the mouth assembly 10 may further include a lower or second jaw 52 having a first end 52A and a second end 52B. In FIG. 3, the second jaw is illustrated as being formed of a rigid material. Referring to FIG. 4, the second jaw 52 may alternately be formed as a lower lip chain 54 including a plurality of links 56, configured in the same manner as the upper lip chain 14. While the inclusion of a moving second jaw 52 or lip chain 54 provides for a greater range of expressions, the inclusion of a static lower structure with the moving upper lip chain 14, or a static upper lip with a moving lower lip chain, is also within the scope of the present invention.

Referring back to FIGS. 2A, 2B, and 3, the mouth assembly 10 further includes a first connecting arm 58 having a first end 58A and a second end 58B and a second connecting arm 60 having a first end 60A and a second end 60B. The first end 58A of the first connecting arm 58 is pivotally coupled to the first linkage 38, and the first end 60A of the second connecting arm 60 is pivotally coupled to the second linkage 40. The second end 58B of the first connecting arm 58 is pivotally coupled to the first end 52A of the second jaw 52, and the second end 60B of the second connecting arm 60 is pivotally coupled to the second end 52B of the second jaw 52.

The bracket 46 fixed on the main frame plate 8 further supports a second jaw axle 62 having a first end 62A and a second end 62B. The second jaw axle 62 extends in parallel with the first jaw axle 48, and is supported at an elevation above the main frame plate 8 but below the first jaw axle 48. The first and second ends 62A, 62B of the second jaw axle 62 pivotally support the second jaw 52 at locations adjacent the first and second ends 52A, 52B, respectively, of the second jaw 52.

Figure 5:
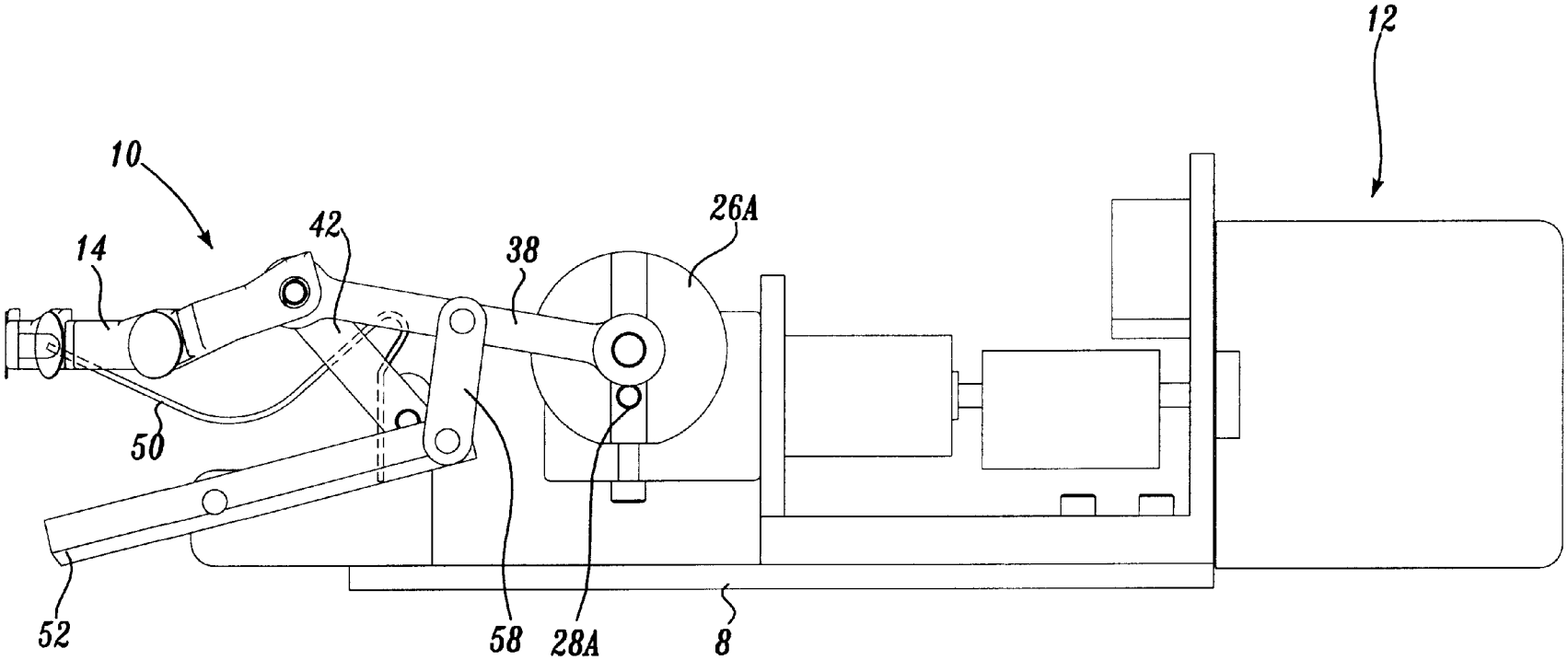
FIG. 5 is a side view of the mechanism of FIG. 2A, wherein cams of the drive assembly have rotated 90 degrees from FIG. 2A.
Figure 6:
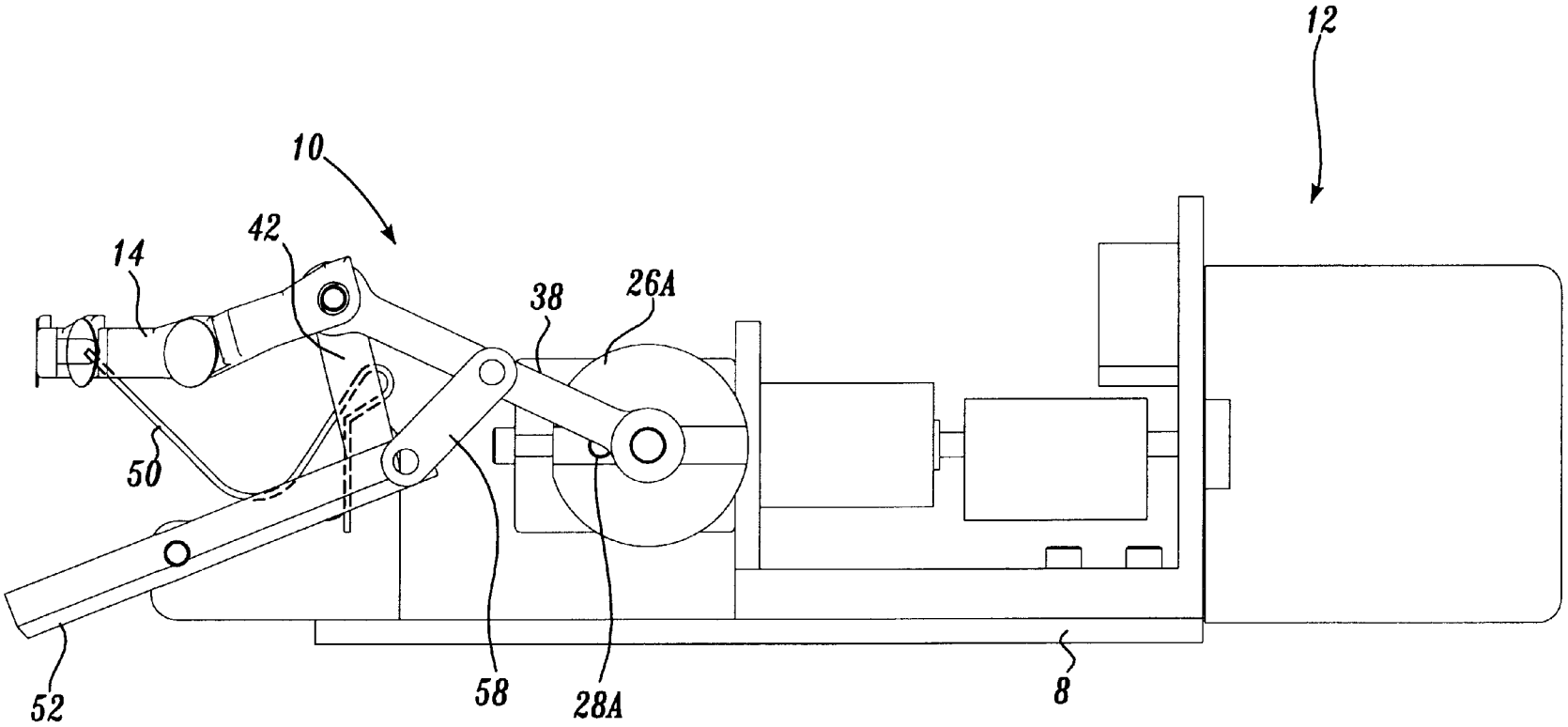
FIG. 6 is a side view of the mechanism of FIG. 2A, wherein cams of the drive assembly have rotated 180 degrees from FIG. 2A.

Operation of the mechanism 7 coupled to the hollow head 4 is now described. FIG. 2B illustrates the mechanism 7 in an initial position. In FIG. 5, the first and second cams 26A, 26B (only the first cam 26A is shown) are rotated 90 degrees from FIG. 2B. With rotation of the first and second cams 26A, 26B, the ends of the first mouth chain 14 are pulled rearwardly and upwardly, while the second jaw 52 is tilted downwardly. The spring 50 biases the center portion 14C of the upper lip chain 14 downwardly to retain its initial position. In FIG. 6, the first and second cams 26A, 26B (only the first cam 26A is shown) are rotated 180 degrees from FIG. 2B. The upper lip chain 14 is further pulled rearwardly and lifted at the ends, while the second jaw 52 is further tilted downwardly. The lips of the mouth 6 of the head 4 elastically deform with the first upper chain 14 and the second jaw 52, with the mouth 6 opening and the corners of the mouth pulling rearwardly and upwardly to form a realistic arcuate smile that curves three-dimensionally. As the first and second cams 26A, 26B rotate further to complete a 360-degree rotation, the upper lip chain 14 and the second jaw 52 retract back to their initial positions of FIG. 2B. The mechanism 7 of the present invention may be activated using any suitable methods, for example, a sound actuation method, as will be apparent to those skilled in the art.

While the present discussion describes the mechanism 7 as used to express a smile, it should be understood that various other facial expressions may be easily achievable in accordance with the present invention. For example, by simply inverting the mouth assembly 10, one may configure a mechanism suited for expressing a frown. As a further example, by independently and alternately lifting opposite ends of the upper lip chain 14 (through the use of independent drive mechanisms or out-of-sync cams), one may accomplish a mechanism that mimics mumbling. Still further alternative facial expressions or facial movements or talking will be readily achievable in accordance with the present invention, as will be apparent to those skilled in the art.

In some instances, it may be preferable to be able to adjust the initial and final angular displacement of the upper lip chain 14 and the second jaw 52, so as to achieve various facial expressions with differing nuances around the mouth 6. The mechanism 7 of the present invention is well suited to effect such adjustments. One way of varying the initial and final angular displacement of the upper lip chain 14 and the second jaw 52 is to vary the distance between the mouth assembly 10 and the drive assembly 12.

Specifically, referring back to FIGS. 2A, 2B, and 3, the drive assembly 12 suitably includes a generally U-shaped drive assembly frame 64 to fixedly support the drive assembly 12 thereon. The drive assembly frame 64 is slidably mounted on the main frame plate 8, which, as described above, fixedly supports the mouth assembly 10 thereon. In the illustrated embodiment, the drive assembly frame 64 defines a first longitudinal slot 66A and a second longitudinal slot 66B that extend in parallel with the axis of the motor power shaft 32. The main frame plate 8 includes at least one hole 68 defined therethrough to underlie either the first longitudinal slot 66A or the second longitudinal slot 66B of the drive assembly frame 64. After sliding the drive assembly frame 64 forward or backward with respect to the main frame plate 8, at least one adjustment pin 70 may be inserted through either the first or second longitudinal slot 66A or 66B of the drive assembly frame 64 into the at least one hole 68 of the main frame plate 8 to selectively secure the drive assembly frame 64 to the main frame plate 8. It should be understood that other means for slidably supporting the drive assembly frame 64 on the main frame plate 8 would be apparent to those skilled in the art.

Figure 7:
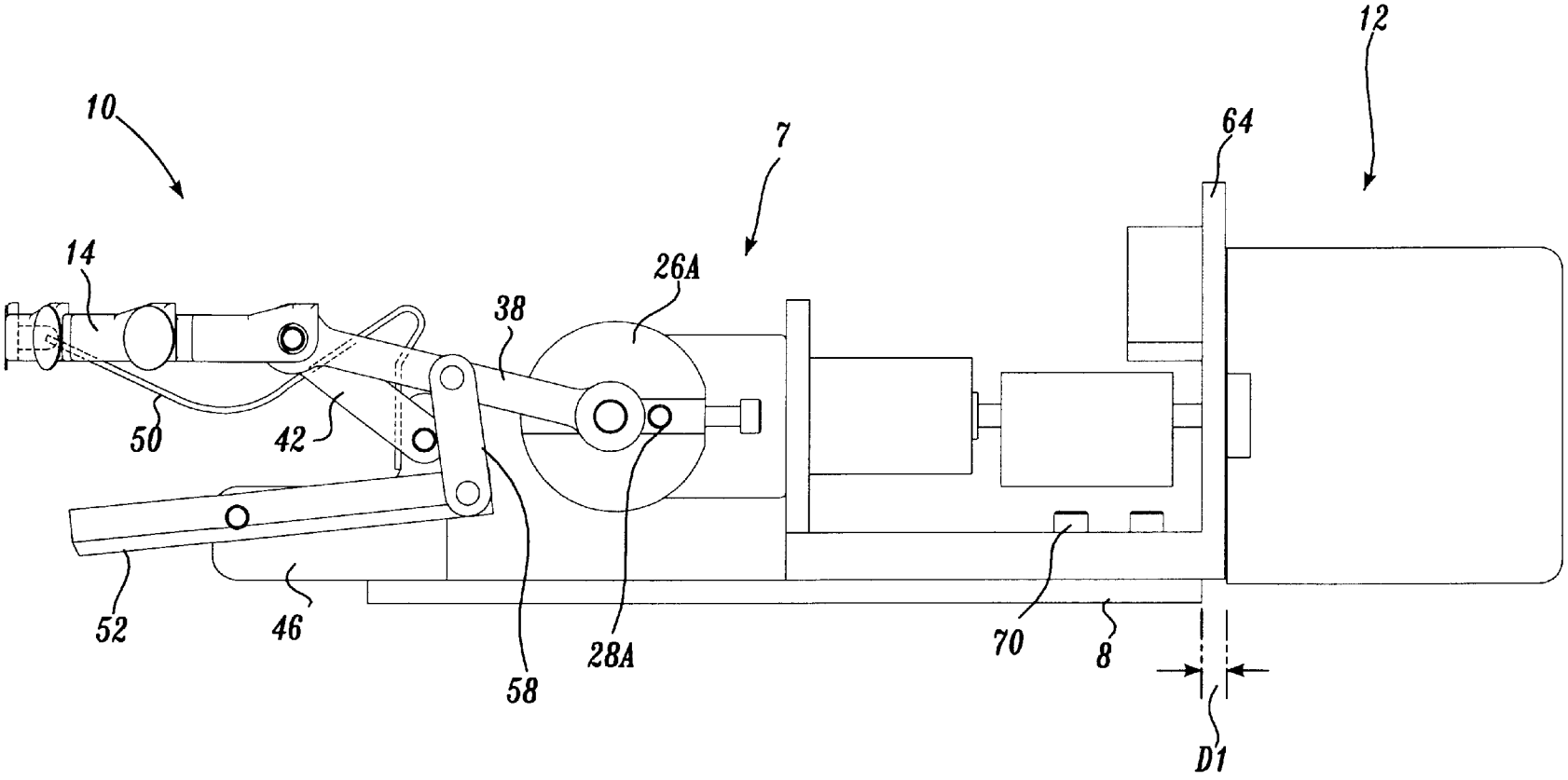
FIG. 7 is a side view of the mechanism of FIG. 2A, wherein the drive assembly is slidably displaced (pulled back) along a length of the drive assembly with respect to the mouth assembly, so as to pull back the mouth assembly to change the initial and final angular displacement of the mouth assembly.

FIG. 7 illustrates the mechanism 7 as illustrated in FIG. 2B, wherein the drive assembly frame 64 is adjusted backward by a distance "D1" relative to the positioning of FIG. 2B. As will be apparent by comparing FIG. 7 and FIG. 2B, the adjustment by horizontal distance "DI" in FIG. 7 results in the first and second linkages 38, 40 (only the first linkage 38 is shown) being pulled backward and tilted up forward. This in turn causes the upper lip chain 14 to be lifted and the second jaw 52 to be slightly tilted down. This is the initial position of the mouth assembly 10 when the drive assembly frame 64 is adjusted backward by the distance "D1". Thus, by slidably adjusting the drive assembly frame 64 with respect to the main frame plate 8, one may vary the initial angular displacement and, thus, subsequent paths of the upper lip chain 14 and the second jaw 52 of the mouth assembly 10. The horizontal adjustment of the drive assembly frame 64 results in concurrent horizontal and vertical adjustment of the movement of the mouth assembly 10. It should be apparent based on the disclosure contained herein that independent vertical and/or horizontal adjustment may instead be arranged.

The mechanism 7 of FIGS. 2A, 2B, and 3 includes an additional adjustment for varying the initial and final angular displacement of the upper lip chain 14 and the second jaw 52. Specifically, the first and second cams 26A, 26B suitably include T-shaped cross-sectional slots 72A and 72B extending along a diameter of the first and second cams 26A, 26B, respectively. First and second nuts 74A, 74B are slidably received within the first and second slots 72A, 72B, respectively. The first nut 74A is assembled with a first bearing 76A, a first washer 78A, and a first cap screw 80A, to complete the first linkage coupler 41A. By loosening the first cap screw 80A, one may slide the first linkage coupler 41A along the first slot 72A of the first cam 26A. At any selected position along the first slot 72A, one may then tighten the first cap screw 80A to secure the first linkage coupler 41A to the first cam 26A. The second linkage coupler 41B (only partially shown) is configured and assembled, likewise, to be slidably mounted to the second slot 72B of the second cam 26B.

Figure 8:
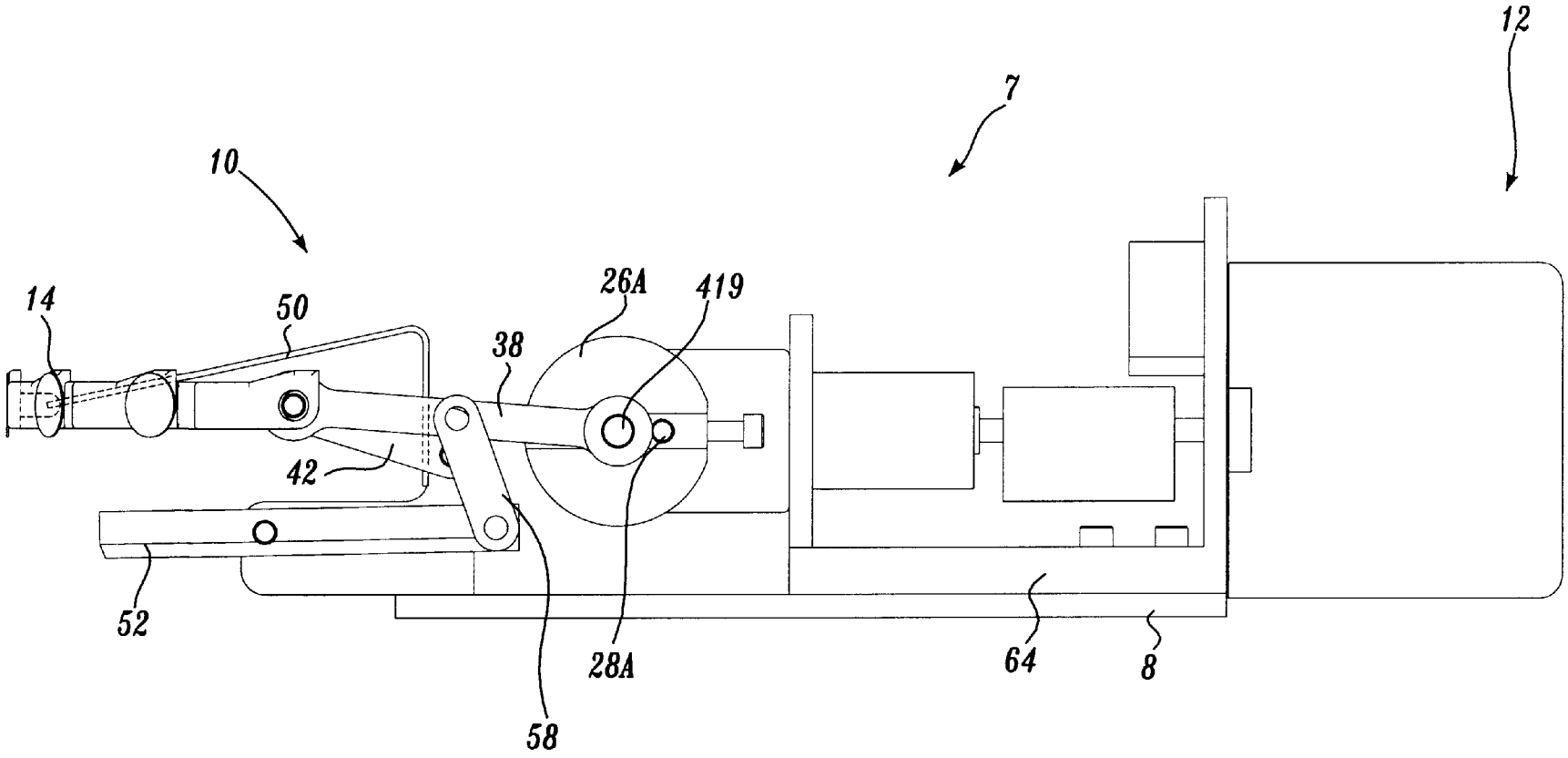
FIG. 8 is a side view of the mechanism of FIG. 2A, wherein linkages of the mouth assembly are coupled to cams of the drive assembly at different locations from FIG. 2A, so as to pull back the mouth assembly to change the initial and final angular displacement of the mouth assembly.

FIG. 8 illustrates the mechanism 7 of FIG. 2A, wherein the first and second linkage couplers 41A, 41B (only the first linkage coupler 41A is shown) are slidably adjusted in the backward direction from FIG. 2A, so as to slightly pull backward and at the same time tilt up the first and second linkages 38, 40 (only the first linkage 38 is shown). This in turn lifts up the ends of the upper lip chain 14 and slightly tilts down the second jaw 52. This is now the initial position of the mouth assembly 10 when the first and second linkage couplers 41A, 41B are slidably adjusted along the slots 72A, 72B, respectively. Therefore, similar to the sliding adjustment of the drive assembly frame 64 with respect to the main frame plate 8 as described above, adjustment of the first and second linkage couplers 41A, 41B along the first and second slots 72A, 72B, respectively, will result in different initial angular displacement and, thus, different subsequent vertical and horizontal paths of the upper lip chain 14 and the second jaw 52, respectively. The linkage couplers 41A, 41B may be suitably employed for a "fine" adjustment after making a "coarse" adjustment by positioning the drive assembly frame 64.

Figure 9A:
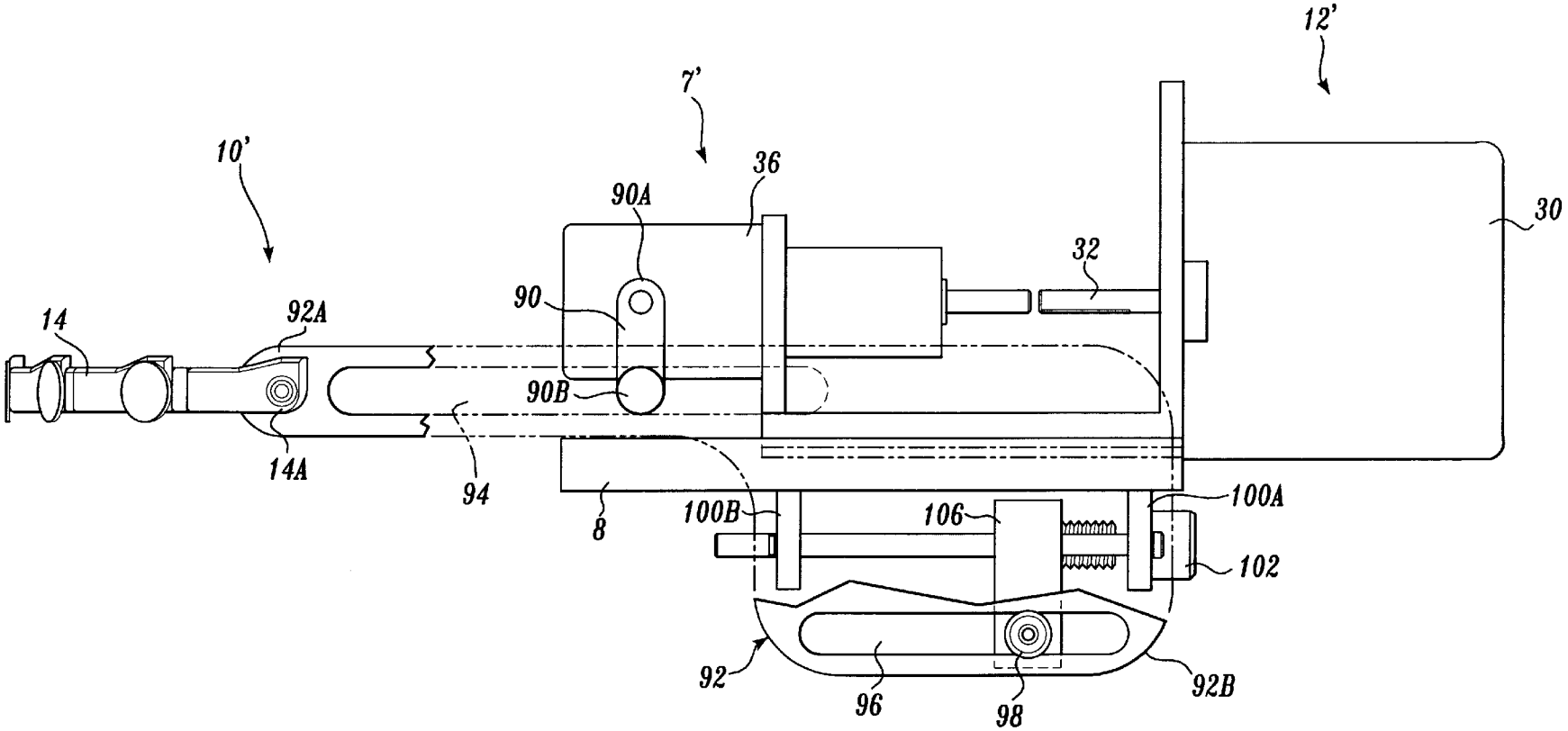
FIG. 9A is a side view of an alternative mechanism including a mouth assembly and a drive assembly, suitable for use in a character of the present invention, wherein the mouth assembly includes a pivotally supported lever arm.
Figure 9B:
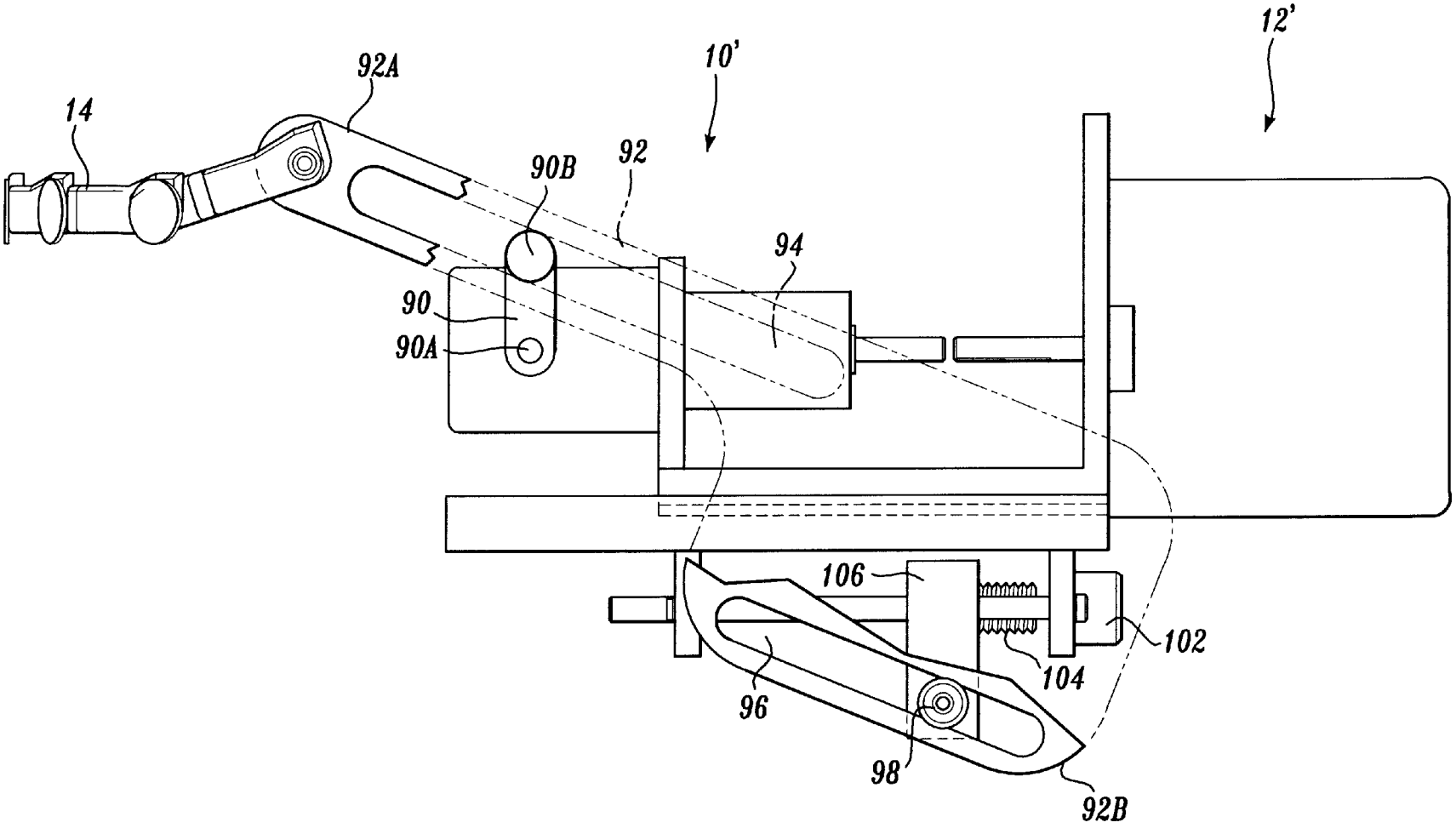
FIG. 9B is a side view of the mechanism of FIG. 9A, wherein cams of the drive assembly have rotated 180 degrees from FIG. 9A to pivotally lift the lever arm.

FIGS. 9A and 9B illustrate an alternative mechanism 7' including an alternative mouth assembly 10' and a drive assembly 12', which are suitable for causing various facial expressions on a toy character's face in accordance with the present invention. The drive assembly 12' includes a first cam 90 having a first end 90A and a second end 90B. Though the following describes only the first cam 90 and its associated components and functions, it should be understood that a mirror image of the first cam 90 and its associated components may be provided to form a second cam and its associated components.

The drive assembly 12' further includes a drive for rotation of the first cam 90. For example, as before, the drive may suitably include an electric motor 30 having a single power shaft 32, which is coupled to a miter gear assembly 36. The miter gear assembly 36 is coupled to the first end 90A of the first cam 90. Thus, when the motor 30 is powered, rotational energy of the power shaft 32 is transmitted via the miter gear assembly 36 to pivot the first cam 90 around the first end 90A of the first cam 90.

The mouth assembly 10' includes the upper lip chain 14, as discussed above, having the first end 14A and the second end 14B. The mouth assembly 10' further includes as a cam follower a first longitudinal lever arm 92 having a distal end 92A and a proximal end 92B. The distal end 92A of the first longitudinal lever arm 92 is pivotally coupled to the first end 14A of the upper lip chain 14.

The first longitudinal lever arm 92 includes a first longitudinal slot 94 along the length of the first longitudinal lever arm 92 adjacent the distal end 92A. The first longitudinal slot 94 slidably receives the second end 90B of the first cam 90 therealong. The first longitudinal lever arm 92 further includes a second longitudinal slot 96 along the length of the first longitudinal lever arm 92 adjacent the proximal end 92B.

The mouth assembly 10' further includes a first pivot point 98 that is adjustably mounted on the main frame plate 8. In the illustrated embodiment, two mounts 100A, 100B, each defining a hole therethrough (not shown), extend from the main frame 8. A shaft 102 having an externally threaded portion 104 is inserted through the hole of each mount 100A, 100B. A pivot point base 106, on which the first pivot point 98 is mounted, includes an internally threaded portion (not shown) and is threaded onto the externally threaded portion 104 of the shaft 102. Thus, by selectively threading the pivot point base 106 onto the externally threaded portion 104 of the shaft 102, one may slidably adjust the position of the first pivot point 98 with respect to the main frame plate 8.

The second longitudinal slot 96 of the first longitudinal lever arm 92 slidably supports the first pivot point 98 therealong. The first pivot point 98 is adapted to be selectively secured at any desired location along the length of the second longitudinal slot 96. Thus, one may slidably adjust a position of the first pivot point 98 with respect to the second longitudinal slot 96 and, hence, with respect to the first longitudinal lever arm 92.

In operation, FIG. 9B illustrates the mechanism 7' of FIG. 9A after the first cam 90 has rotated by 180 degrees around the first end 90A of the first cam 90. When the first cam 90 is rotated, the first longitudinal lever arm 92 pivots around the first pivot point 98 and lifts up the corresponding end of the upper lip chain 14. As the first cam 90 rotates further to complete a 360-degree rotation, the upper lip chain 14 retracts to its initial position of FIG. 9A. As apparent from the foregoing description, by adjusting the location of the first pivot point 98 with respect to the main frame 8 using the shaft 102 and the pivot point base 106, and/or adjusting the location of the first pivot point 98 with respect to the second longitudinal slot 96 of the first longitudinal lever arm 92, one may adjust the location of the pivot point 98 of the first longitudinal lever arm 92 with respect to the pivot point (90A) of the first cam 90, so as to vary the throw of the upper lip chain 14.

Figure 10D:
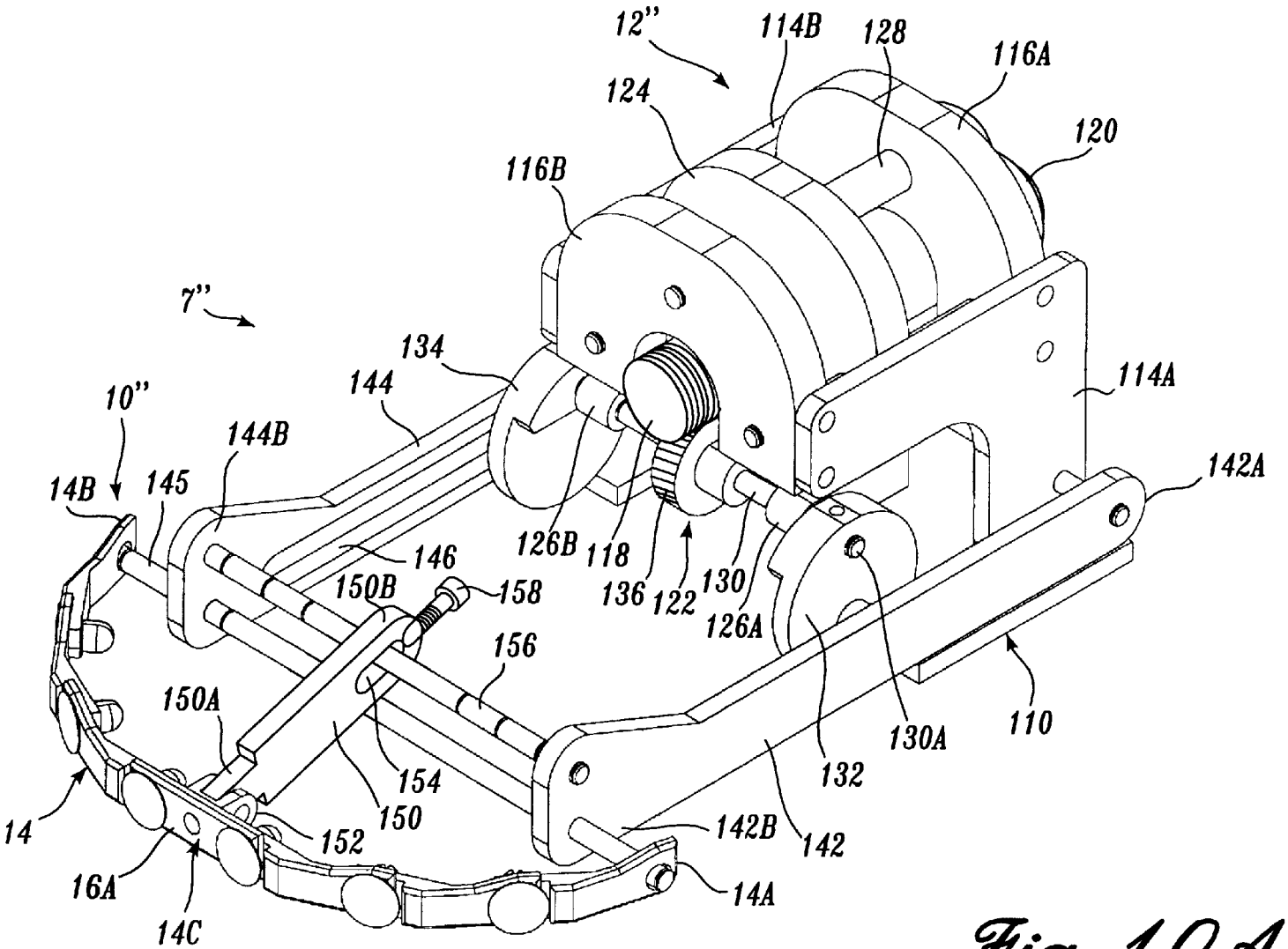
FIG. 10A is a perspective view of yet another alternative mechanism including a mouth assembly and a drive assembly, wherein the mouth assembly includes a pivotally supported lever arm.
FIG. 10B is a bottom view of the mechanism of FIG. 10A.
Figure 10B:
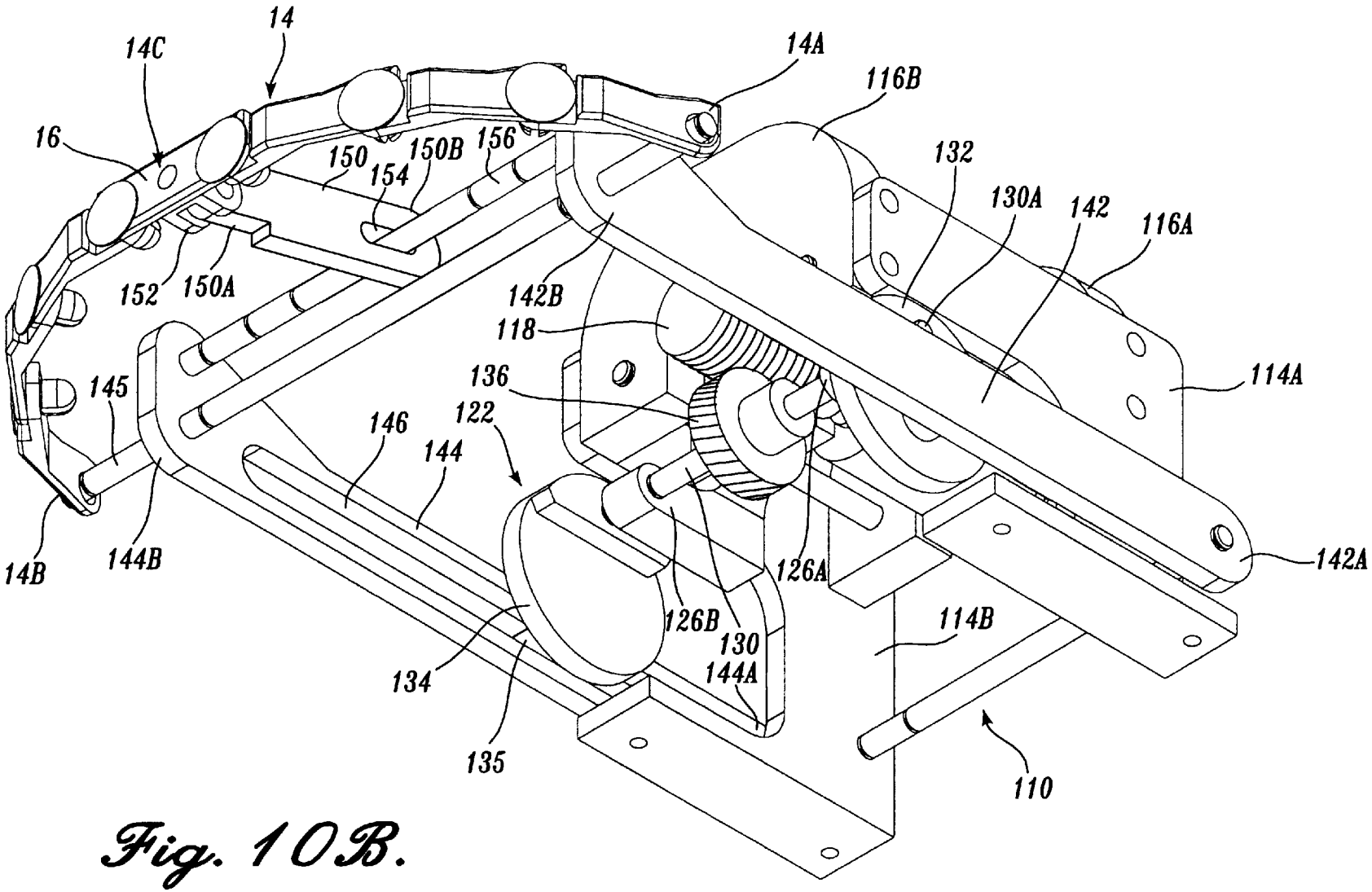

FIGS. 10A and 10B illustrate yet another alternative embodiment of a mechanism 7" including an alternative mouth assembly 10" and a drive assembly 12", suitable for adjusting the throw of the lip chain to effect various facial expressions on a character's face. The drive assembly 12" includes a drive assembly frame 110, which includes a pair of side brackets 114A, 114B and a pair of support brackets 116A, 116B. A worm 118 and a motor 120 for rotating the worm 118 are mounted on the drive assembly frame 110 through the pair of support brackets 116A, 116B.

The drive assembly 12" further includes a cam assembly 122, which is slidably mounted on the drive assembly frame 110. The slidable cam assembly 122 includes a sliding bracket 124 having two arms 126A, 126B. The sliding bracket 124 is placed in parallel with the pair of support brackets 116A, 116B, and is adapted to adjustably slide therebetween. In the illustrated embodiment, an adjustment screw 128 is used to selectively fix the sliding bracket 124 with respect to the drive assembly frame 110. The slidable cam assembly 122 further includes an axle 130 having a first end 130A and a second end 130B (only the first end 130A is shown), which are supported through the pair of arms 126A, 126B, respectively, of the sliding bracket 124. An eccentric first cam 132 and an eccentric second cam 134 are coupled to the first and second ends 130A, 130B, respectively, of the axle 130. Each cam 132, 134 includes a cam eccentric 135 projecting therefrom (only the eccentric 135 of the second cam 134 is shown in FIG. 10B). Further, a worm gear 136 is coaxially mounted on the axle 130. The worm gear 136 engages with the worm 118 mounted on the motor drive assembly 12" to form a conventional worm gear drive. When constructed, the drive assembly 12" moves as an entire unit along with the cam back and forth in slots provided in lever arms, as more fully described below.

The mouth assembly 10" includes a lip chain 14 having a first end 14A, a second end 14B, and a central portion 14C, which are constructed as described above. The mouth assembly 10" further includes first and second lever arms 142, 144, each having a first end 142A or 144A and a second end 142B or 144B. The first ends 142A, 144A of the lever arms are pivotally coupled to the side brackets 114A, 114B, respectively, of the drive assembly frame 110. The second ends 142B, 144B of the lever arms are coupled to the first and second ends 14A, 14B, respectively, of the lip chain 14, using any suitable means. In the illustrated embodiment, a dowel pin 145 is used to pivotally couple the first and second ends 14A, 14B of the chain to the second ends 142B, 144B of the lever arms. Each lever arm 142, 144 includes a longitudinal slot 146 (only the slot 146 for the second lever arm 144 is shown), extending in parallel with the length of the lever arm. Each longitudinal slot 146 slidably receives therein the cam eccentric 135 projecting from the corresponding cam.

In operation, by slidably adjusting the cam assembly 122 which also adjusts the motor drive assembly with respect to the drive assembly frame 110, one may adjust the relative positions of the cam eccentrics 135 with respect to the longitudinal slots 146 of the lever arms 142, 144, respectively. This adjustment will result in different throws of the lip chain 14, when the cams subsequently rotate. Specifically, when the cam eccentrics 135 and, thus, the cams 132, 134 are positioned farther away from the upper lip chain 14 along the longitudinal slots 146, the cams' rotation will result in a larger throw (i.e., a throw having a larger arc length) to effect, for example, a guffaw. When the cam eccentrics 135 are positioned closer to the upper lip chain 14, on the other hand, the throw of the chain 14 will be smaller. Though not illustrated, the coupling positions of the first ends 142A, 144A of the lever arms to the side brackets 114A, 114B, respectively, may also be made adjustable to adjust the pivot points of the lever arms 142, 144, similarly to the embodiment illustrated in FIGS. 9A and 9B, to further increase adjustment possibilities.

Optionally, a chain holder 150 having a first end 150A and a second end 150B may be used to support the lip chain 14 and to, for instance, prevent the chain 14 from sagging undesirably while retaining the position of the center portion of the chain 14 during curvature of the chain. The first end 150A of the chain holder 150 is pivotally coupled to the central portion 14C of the lip chain 14. To this end, a central link 16A forming the link chain 14C includes an anchor 152 for pivotally coupling the first end 150A. The second end 150B of the chain supporter 150 defines a generally elongate slot 154, which passes a rod 156 therethrough extending between the second ends 142B, 144B of the lever arms 142, 144. Further optionally, a set screw 158 (only shown in FIG. 10B) is suitably used to adjust the size of the elongate slot 154 and, thus, the area of free movement for the rod 156 within the slot 154. Such adjustment will further effect different nuances around the mouth of a character. For example, when the slot 154 is made smaller, the lip chain 14, in particular the central portion 14C thereof, will be pulled closer to the rod 156 to effect a smaller smile, while, when the slot 154 is made larger (or longer), the lip chain 14 will protrude away from the rod 156 and sag further to effect a bigger smile.

While several preferred embodiments of the invention have been illustrated and described, it will be appreciated that various changes can be made therein without departing from the spirit and scope of the invention. For instance, a single chain configured to curve upwardly for a smile, or downwardly for a frown, can be utilized. This chain can be combined with or without a second chain or other rigid or jointed lip support. A chain consisting of links that slidably extend and lock may be used so that the initial form of a lip chain will be straight rather than an arcuate smile configuration. In this type of chain, each link is coupled with a spring to bias the link to be aligned with the other links in a straight line. Instead of a chain, another flexible or jointed lip support can be utilized. Rather than the cam arrangements described above to move the ends of the chain, other linkages such as cables and pulleys can be utilized. Rather than moving the ends of the lip chain while holding the center of the chain stationary, more or all points can move vertically and/or horizontally, or the center can move while the ends are stationary to more accurately mimic smiles, frowns, guffawing, mumbling, or speech. Thus various alterations and variations of the preferred embodiments can be designed in accordance with the disclosure contained herein, to achieve a mechanism that moves the mouth of a portable, lightweight character for individual consumer use in a realistic arcuate fashion, rather than merely opening and closing the mouth, and preferably that moves the mouth three-dimensionally.

What is claimed is:

1. A character capable of forming facial expressions, comprising:

(a) a facial structure formed at least partially of an elastically deformable material defining a mouth, the mouth having a first end portion and a second end portion; and (b) a mouth movement mechanism coupled to the facial structure including:

(i) a main frame, (ii) a mouth assembly mounted on the main frame, the mouth assembly comprising a first mouth chain having a first end and a second end and including a plurality of links, the first mouth chain underlying the mouth, the first and second ends of the first mouth chain generally coupled to the first and second end portions of the mouth, respectively, and (iii) a drive assembly mounted on the main frame for moving at least one of the first and second ends of the first mouth chain and, hence, the corresponding end portion of the mouth to effect a facial expression.

2. The character of claim 1, wherein the drive assembly comprises:

a first cam having a first rotational axis, the first cam being coupled to the at least one end of the first mouth chain; and a drive motor for rotating the first cam.

3. The character of claim 2, wherein the first cam comprises an eccentric cam, further comprising a linkage pivotally coupled to the first cam and to the at least one end of the first mouth chain.

4. The character of claim 2, further comprising an elongate lever arm having a proximal end pivotally coupled to the main frame and a distal end pivotally coupled to the mouth chain, the elongate lever arm defining a first longitudinal slot defined along a length of the lever arm, the first cam being slidably coupled to the lever arm by a pin received within the first longitudinal slot.

5. The character of claim 4, wherein the first slot of the elongate lever arm is defined adjacent the distal end thereof, the elongate lever arm further defining a second slot adjacent the proximal end thereof that slidably receives a pin to mount the elongate lever arm to the main frame.

6. The character of claim 2, wherein the drive assembly further comprises a second rotatable cam having a second rotational axis, the first end of the first mouth chain being pivotally coupled to the first cam and the second end of the first mouth chain being pivotally coupled to the second cam for movement of the first and second end portions of the mouth, respectively.

7. The character of claim 6, wherein the first and second rotational axes of the first and second cams are aligned, the first and second cams both being drivingly coupled to the drive motor.

8. The character of claim 6, wherein the mouth assembly further comprises first and second linkages each pivotally coupled at a first end to a corresponding one of the first and second cams, and at a second end to a corresponding one of the first and second end portions of the first mouth chain.

9. The character of claim 1, wherein the drive assembly is coupled to each of the first and second ends of the first mouth chain for movement of both end portions of the mouth.

10. The character of claim 9, wherein the mouth assembly further comprises a spring attached to the main frame, the spring being coupled to the first mouth chain to bias a center portion of the first mouth chain toward the main frame.

11. The character of claim 9, wherein the drive assembly is constructed to move the ends of the first mouth chain upwardly and downwardly relative to a center portion of the first mouth chain.

12. The character of claim 11, wherein the drive assembly frame is constructed to move the ends of the first mouth chain rearwardly and forwardly relative to a center portion of the first mouth chain.

13. The character of claim 12, wherein the drive assembly is selectively adjustable to adjust the extent of vertical and/or horizontal movement of the ends of the first mouth chain.

14. The toy character of claim 11, wherein the drive assembly is selectively adjustable to adjust the extent of vertical movement of the ends of the first mouth chain.

15. The character of claim 1, wherein the drive assembly further includes a drive assembly frame for fixedly supporting the drive assembly thereon, the drive assembly frame being slidably mounted on the main frame.

16. The character of claim 8, wherein the first and second linkages are adjustably mounted to the first and second cams, respectively, to adjust the proximity of the first ends of the linkages to the axes of rotation of the cams.

17. The character of claim 8, wherein the mouth assembly further comprises a movable second mouth support having a first end and a second end, the first and second ends being coupled to the first and second linkages, respectively, to move in conjunction with the first mouth chain.

18. The character of claim 17, wherein the second mouth support comprises a chain including a plurality of links.

19. The character of claim 17, wherein the second mouth support comprises a rigid jaw.

20. The character of claim 1, wherein the first mouth chain comprises an upper lip chain.

* * * * *